US005857335A

United States Patent [19]

Tomoiu

[11] Patent Number: 5,857,335

[45] Date of Patent: Jan. 12, 1999

[54] HYDRAULIC IMPULSE ROTATIONAL MOTOR

[76] Inventor: Constantin Tomoiu, 114 Merchant St., Bridgeport, Conn. 06604

[21] Appl. No.: 709,339

[22] Filed: Sep. 6, 1996

[51] Int. Cl.[6] ..... F15B 3/00

[52] U.S. Cl. ..... 60/579; 60/581; 417/383

[58] Field of Search ..... 60/532, 579, 581; 417/383

[56] References Cited

U.S. PATENT DOCUMENTS

| | | | |
|---|---|---|---|
| 2,838,950 | 6/1958 | Symon et al. | 60/579 |
| 2,869,326 | 1/1959 | Wallace | 60/579 |
| 3,028,727 | 4/1962 | Anston | 417/383 |
| 3,457,840 | 7/1969 | Grimes . | |
| 3,482,401 | 12/1969 | Waite | 60/579 |
| 4,505,115 | 3/1985 | Arbuckle | 60/579 |
| 5,522,302 | 6/1996 | Yuda et al. . | |

*Primary Examiner*—F. Daniel Lopez

*Attorney, Agent, or Firm*—Fattibene & Fattibene; Paul A. Fattibene; Arthur T. Fattibene

[57] ABSTRACT

A hydraulic pressure amplifier, coupled to a turbine, for creating a fluid impulse directed to a blade of the turbine causing it to rotate. The hydraulic pressure amplifier is comprised of a series of connected sections with each section having a large cylinder and a small cylinder with a large piston and a small piston placed therein. The small piston providing an amplified force applied to the larger surface area of the larger piston through hydraulic coupling to effectively amplify an initial pressure or force. As a result very high forces are generated with relatively small movement. A free piston placed in an impulse cylinder in an end section is struck, causing a fluid impulse. The fluid impulse creates an impulse wave used to move a blade of a turbine, causing a shaft to rotate. An efficient rotational motor is achieved that has many practical applications. Additionally, the hydraulic pressure amplifier may be used in any application where a very high force is desired with relatively little motion.

10 Claims, 3 Drawing Sheets

HYDRAULIC IMPULSE ROTATIONAL MOTOR

FIELD OF THE INVENTION

The invention relates generally to a hydraulic system, and more particularly to the amplification of hydraulic pressure creating an impulse source used with a turbine.

BACKGROUND OF THE INVENTION

There are many different hydraulic systems used to do various kinds of work. Additionally, there are many turbine systems using fluids to drive the impellers or blades. Most of these turbine systems require relatively large fluid flow in order to provide sufficient energy to drive the turbine. There is a need for a more efficient turbine system and a hydraulic system that can generate large hydraulic forces including an impulse.

SUMMARY OF THE INVENTION

The present invention is directed to a hydraulic pressure amplifier having a plurality of sections with each section having a large cylinder and a small cylinder therein. Placed within each large and small cylinder is a large and small piston. The sections are connected serially such that the output of one forms the input of another. As a result, the hydraulic pressure generated in each section is amplified by the next section, resulting in a very high hydraulic pressure at the output of the last section. The relatively high hydraulic pressure is used to drive a free piston, creating an impulse wave. This impulse wave is caused to strike the blade of a turbine which has its blades immersed in a fluid. The impulse wave causes the blades of the turbine to rotate, turning a shaft for performing work. A pump is used to return fluid to a cylinder containing the free piston to repeat the cycle.

Accordingly, it is an object of the present invention to cause rotational motion with a hydraulic impulse wave.

It is an other object of the present invention to amplify hydraulic forces.

It is an advantage of the present invention that there is relatively little fluid flow.

It is another advantage of the present invention that relatively high forces are generated with relatively small movements.

It is a feature of the present invention that a hydraulic impulse source is coupled to a turbine.

It is another feature of the present invention that a free piston is used to generate the hydraulic impulse wave.

These and other objects, advantages and features will become readily apparent in view of the following detailed description.

DETAILED DESCRIPTION OF THE PREFERRED EMBODIMENTS

Figure 1:
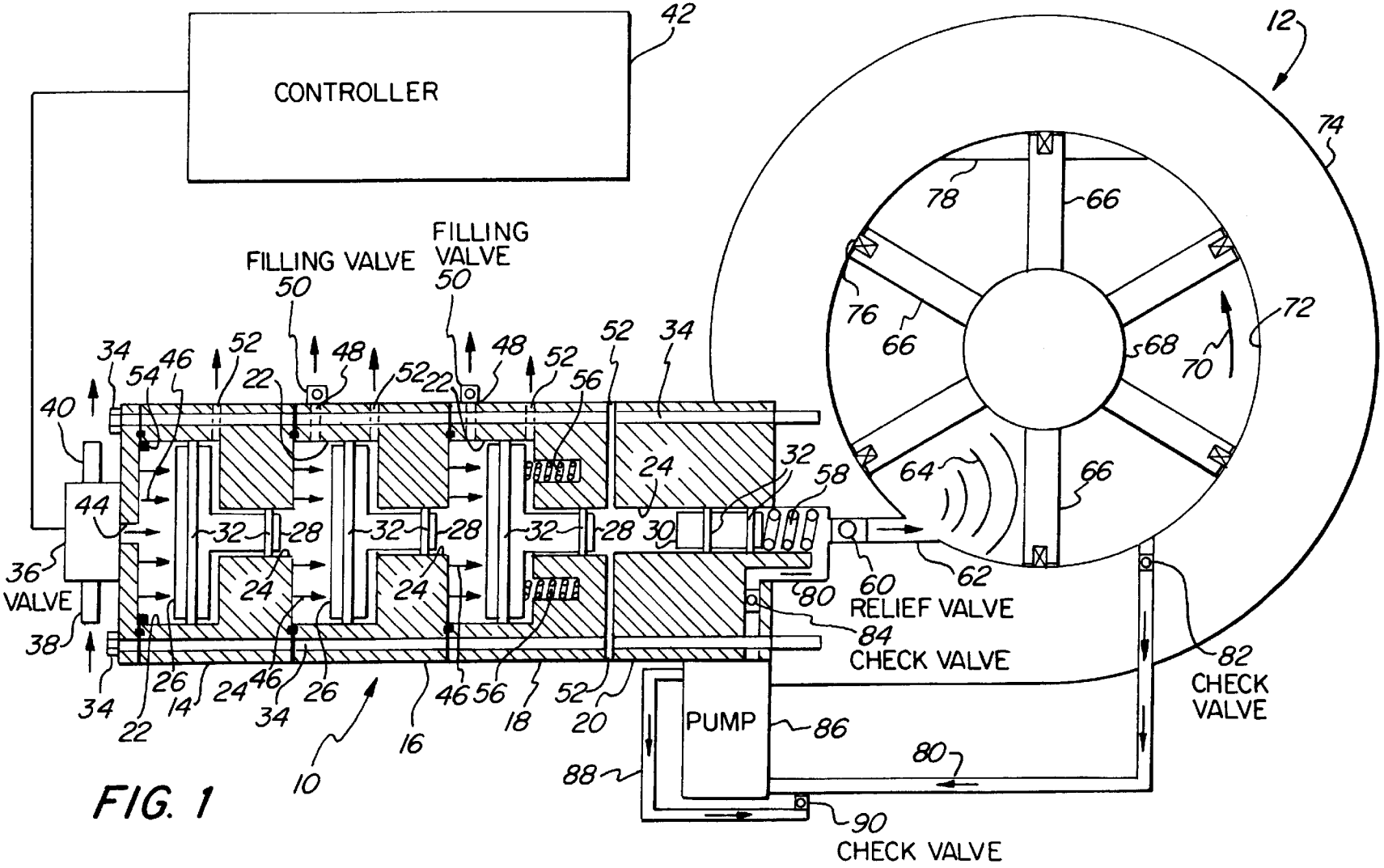
FIG. 1 is a schematic cross section illustrating the present invention.

FIG. 1 generally illustrates one embodiment of the present invention. A hydraulic pressure amplifier 10 is attached to a turbine 12. The high pressure amplifier 10 is made up of a plurality of sections. A first section 14, a second section 16, a third section 18, and a fourth or end section 20 are bolted together by bolts 34. Each of the first, second, and third sections 14, 16, and 18 have a large cylinder 22 and a small cylinder 24 formed therein. The first, second, and third sections are serially connected such that the small cylinder 24 opens to the large cylinder 22 of the next adjacent attached section. Within each section is placed a large piston 26 and an associated small piston 28. The diameter of the large pistons 26 is substantially greater than the diameter of the small pistons 28. Each of the large pistons 26 and the small pistons 28 are sealed within the large cylinder 22 and the small cylinder 24 respectively by seals or rings 32. The end or fourth section 20 has a small cylinder 24 therein. Placed in small cylinder 24 is a free piston 30. The free piston 30 is free to move within the small cylinder 24 in the fourth or end section 20. Seals or rings 32 are used to seal the small cylinder 24 and the free piston 30. This fourth or last section 20 creates a fluid impulse. A valve 36 is attached to one end of the first section 14. The valve 36 has an input 38 and an output 40. The valve 36 is controlled by controller 42. Controller 42 controls the opening and closing of valve 36, as well as the amount of pressure or force provided to the first section 14. Valve 36 causes a fluid, such as a gas or liquid, to enter opening 44 in the first section 14. Arrows 46 represent forces applied to the surface of large piston 26. Stops 54 are used to prevent the large piston 26 in the first section 14 from sealing the opening 44. The pressure on the large piston 26 within the first section 14 is effectively transferred by the small piston 28 to the second section 16. Hydraulic fluid is contained in the large cylinders 22 of the second and third sections 16 and 18. The movement of the small piston 28 in the first section 14 results in an increase in hydraulic pressure within the large cylinder 22 of the second section 16. This hydraulic pressure represented by arrows 46 within the second section 16 is effectively transmitted to the surface of the large piston 26 in the second section 16, causing the small piston 28 in the second section 16 to move forward. This causes a corresponding increase in hydraulic pressure within the third section 18, represented by arrows 46. This hydraulic pressure results in a large force being transmitted to the small piston 28 within the third section 18. As a result, a very small movement with a very large force is provided. The small piston 28 within the third section 18 is caused to strike the free piston 30 within bore 24 in the fourth or end section 20, advancing the free piston 30 forward. Within bore 24 of the fourth or end section 20 and ahead of the piston 30 is a column of fluid, such as hydraulic fluid. The advancing free piston 30 causes an impulse of fluid to exit through relief valve 60 into turbine passage 62. The turbine passage 62 is smaller than the small cylinder 24 in which the free piston 30 is placed. The resulting fluid flow 64 strikes one of the turbine blades 66, causing shaft 68 to rotate in the direction of arrow 70. The turbine blades 66 are placed within a bore 72 of a housing 74. Between the bore 72 and the turbine blades 66 are seals 76. The turbine blades 66 are substantially completely immersed in a fluid having a surface level 78. A return passage 80, having a check valve 82 therein, provides a fluid input for pump 86. Pump 86 is used to pump fluid from the turbine bore 72 to the small cylinder 24 in the fourth or end section 20. A check valve 84 is used between the pump 86 and the fourth or end section 20. A pump by-pass 88 with an associated check valve 90 couples the output of the pump 86 to the return passage 80, permitting the pump to be in continuous operation even when fluid is not returning in the return passage 80. The relief valve 60 is set to open at a predetermined pressure greater than the pressure provided by the pump 86.

The movement of the large and small pistons 26 and 28 in the first, second, and third sections 14, 16, and 18 is facilitated with the use of vents 52, which reduces or prevents air pressure from increasing due to the movement of the large pistons 26. Additionally, the large cylinders 22 in the second and third sections 16 and 18 are initially charged with hydraulic fluid injected through passage 48 and sealed with valve 50. The cylinder 24 within the fourth or end section 20 is also vented with a vent 52. Bumper springs 56 are associated with the third section 18, providing a cushion or shock absorbing device for the large piston 26 within the third section 18. A return spring 58 is used to return free piston 30 to a position adjacent or near the last small piston 28 in the third section 18.

Figure 2:
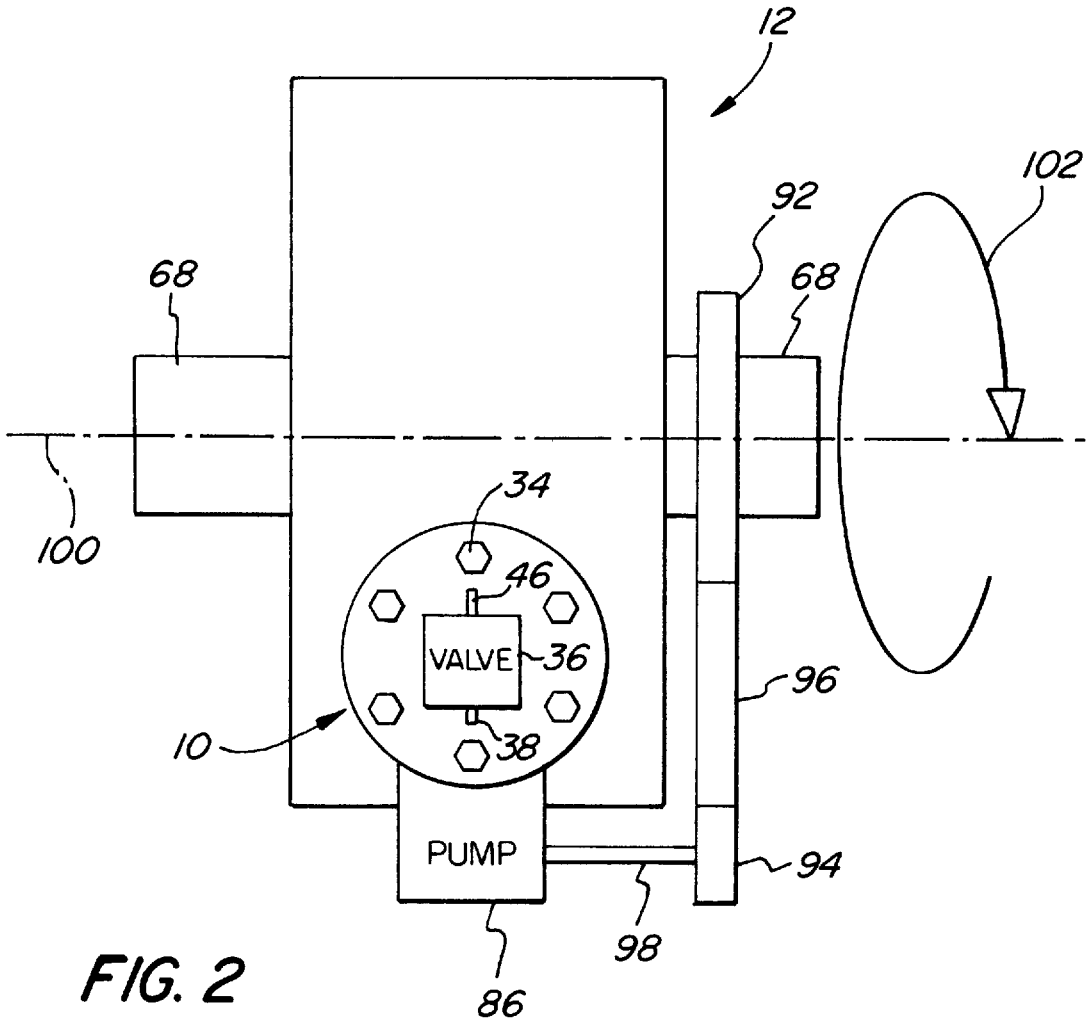
FIG. 2 is a front elevational view schematically illustrating the present invention.

FIG. 2 is a front elevational view illustrating the use of the output of the turbine shaft 68 to drive the pump 86. A shaft pulley 92 is attached to turbine shaft 68. A pump pulley 94 is attached to a pump shaft 98. The shaft pulley 92 and the pump pulley 94 are attached by a belt 96. Accordingly, when the turbine shaft 68 rotates on axis 100 in the direction of arrow 102, the pump pulley 94 is caused to rotate, driving the pump 86.

The operation of the present invention can readily be appreciated with reference to FIGS. 1 and 2. The hydraulic pressure amplifier 10 provides the force for creating a fluid impulse to the turbine 12. The fluid impulse causes an impulse wave 64 to strike a blade 66, causing the shaft 68 to rotate. Fluid within the turbine bore 72 is returned by pump 86 to provide fluid for creating another impulse of fluid. The hydraulic pressure amplifier 10 is used to create a relatively high force with a relatively small movement to drive the free piston 30, causing the fluid impulse. Controller 42 selectively controls valve 36, providing a means for moving the large piston 26 in the first section 14. The large piston 26 in the first section may be moved by any means such as air pressure, hydraulic pressure, or even electromagnetic force. The force exerted on the surface of the large piston 26 in the first section is caused to be amplified by the reduced surface area of the small piston 28 in the first section 14, which is in contact with hydraulic fluid within the large cylinder 22 of the second section 16. The hydraulic fluid, being substantially incompressible, caused the pressure to be transmitted over the entire surface area of the large cylinder 22 within the second section 16. This force is effectively amplified and applied to the smaller surface area of small piston 28 within the second section 16, which is similarly in contact with hydraulic fluid within the large cylinder 22 of the third section 18. Accordingly, a very large force is effectively applied to the free piston 30 within the fourth or end section 20 by the small piston 28 in the third section 18. This relatively large force with a relatively very small movement drives the free piston 30 quickly forward causing the fluid contained within the small cylinder 24 of the fourth or end section to be ejected from the turbine passage 62. It should be appreciated that a plurality of sections may be used to obtain any desired very high hydraulic pressure or force by serially connecting the plurality of sections such that the output of one becomes the input of the next adjoining or adjacent section. The fluid impulse creates an impulse wave 64 within the fluid contained within bore 72 of the turbine 12. This impulse wave 64 strikes blade 66, causing the shaft 68 to rotate. The fluid is returned to the small cylinder 24 in the fourth or end section 20 by pump 86, forcing the free piston 30 back against the surface of the small piston 28 in the third section 18. The controller 42, which may be a microprocessor, causes the large piston 26 within the first section 14 to advance, creating another impulse. This process or cycle is continuously repeated, causing the turbine 12 to rotate about shaft 68, thereby performing work. As a result, very little motion is generated with a large portion of the energy being transformed to rotational work with high efficiency. Accordingly, very little energy is wasted, providing very efficient operation. The free piston 30 receives a high impulse force from the hydraulic amplifier according to the following equation:

$$Fdt=mdv$$

where:
F=Force
dt=Time
m=Mass, and
dv=Velocity.

This force results in kinetic energy according to the following equation:

$$E_C = \frac{mv^2}{2}$$

This kinetic energy is transferred from the free piston 30 to the turbine blades 66 by the fluid flow 64 causing the liquid and the blades 66 of the turbine 12 to rotate. The liquid in rotational motion has a kinetic energy according to the following equation:

$$\epsilon_C = \sum_{j=1}^{N} \frac{m_j v_j}{2}$$

where,
N=number of particles in liquid,
$m_j$=mass of jth particle, and
$v_j$=velocity of jth particle.

This rotational motion is transferred to the blades 66 and fluid contained in the turbine chamber and transferred to the shaft 68 without undue loss of kinetic energy.

Figure 3:
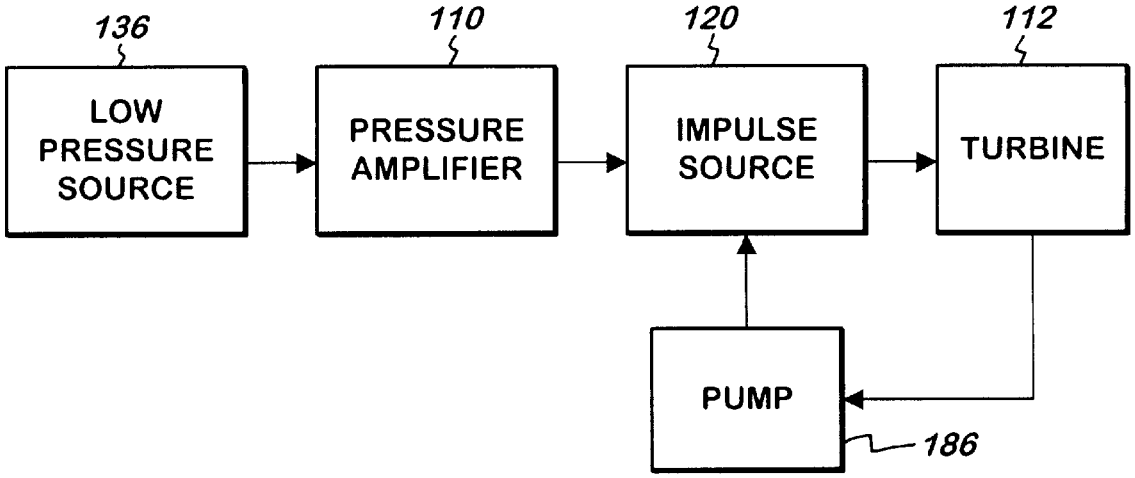
FIG. 3 is a block diagram illustrating the present invention.

FIG. 3 is a block diagram generally illustrating the present invention. A low pressure source 136, for example pneumatic, hydraulic, electromagnetic, or mechanical including vibration provides a low pressure force to the pressure amplifier 110. The pressure amplifier 110 amplifies the low pressure provided by the low pressure source 136 resulting in a relatively high pressure. This relatively high pressure applied to an impulse generator 120. The impulse source 120 uses the relatively high pressure created by the pressure amplifier 110 to create an impulse. The impulse is applied to the turbine 112 causing it to rotate. Pump 186 is coupled between the turbine 112 and the impulse source 120 and returns the fluid used to drive the turbine 112 to the impulse source 120.

Accordingly, the present invention provides a hydraulic pressure amplifier that is used to create a fluid impulse used in combination with a turbine. The resulting motor is very efficient, having many practical applications. Additionally, the hydraulic pressure amplifier may be used in other ways where a very high force with a small movement is needed. Several examples of the usefulness of the present invention have been illustrated, and it will be obvious to artisans skilled in the arts to apply the teachings of this invention to other respective arts. Additionally, it will be obvious to those skilled in the art that various modifications may be made without departing from the spirit and scope of this invention.

What is claimed is:

1. A hydraulic impulse motor comprising:

a turbine having a plurality of blades immersed in a hydraulic fluid;

a fluid impulse source directed to one of said plurality of blades, said fluid impulse source comprising;

a free piston cylinder having a diameter;

a turbine passage open to said free piston cylinder, said turbine passage being smaller than the diameter of said free piston cylinder;

a relief valve placed in said turbine passage;

a free piston, placed within said free piston cylinder, having a first end and a second end, the first end positioned adjacent said turbine passage;

a pressure amplifier placed adjacent the second end of said free piston, whereby said pressure amplifier causing the striking of said free piston transforming high pressure energy into kinetic energy; and a pump connected to said turbine and said fluid impulse source, whereby said fluid impulse source provides an impulse to the blades causing said turbine to rotate.

2. A hydraulic impulse motor as in claim 1 further comprising:

a low pressure source coupled to said pressure amplifier.

3. A hydraulic impulse motor as in claim 1 wherein said pressure amplifier comprises:

a first cylinder having a first diameter;

a second cylinder having a second diameter, the first diameter being larger than the second diameter;

a first piston placed in said first cylinder;

a second piston attached to said first piston placed in said second cylinder;

a third cylinder having a third diameter, coupled to said second cylinder, the third diameter being larger than the second diameter; and a third piston placed in said third cylinder, whereby a first predetermined pressure of fluid in said first cylinder is amplified by said second piston creating a second predetermined pressure, the second predetermined pressure being greater than the first predetermined pressure, the second predetermined pressure being applied to the third piston.

4. A hydraulic impulse motor as in claim 3 further comprising:

a valve coupled to said first cylinder; and a controller, said controller selectively opening and closing said valve.

5. A hydraulic impulse motor as in claim 4 wherein:

said valve is a pneumatic valve.

6. A hydraulic impulse motor as in claim 5 wherein:

said valve is a hydraulic valve.

7. A hydraulic impulse motor comprising:

a turbine having a plurality of blades immersed in a hydraulic fluid;

a fluid impulse source directed to one of said plurality of blades; and a pump connected to said turbine and said fluid impulse source, wherein said pump is driven by said turbine, whereby said fluid impulse source provides an impulse to the blades causing said turbine to rotate.

8. A hydraulic impulse motor comprising:

a plurality of sections, each of said plurality of sections having a large and a small cylinder therein, said plurality of sections being serially connected such that each of the small cylinders opens to an adjacent large cylinder, said plurality of sections having a low pressure input end and a high pressure output end;

a plurality of pistons, one of said plurality of pistons placed within each of said plurality of sections, each of said plurality of pistons having a large diameter portion matched to the large cylinder and a small diameter portion matched to said small cylinder;

a valve connected to the low pressure input end;

a controller connected to said valve;

an impulse section having an impulse cylinder therein attached to the high pressure output end of said plurality of sections, said impulse section having an impulse output;

a free piston placed within the impulse cylinder, said free piston positioned to contact one of said plurality of pistons, whereby high pressure energy is converted into kinetic energy;

a turbine passage coupled to said impulse cylinder, said turbine passage being smaller than said impulse cylinder;

a relief valve placed in said turbine passage;

a turbine housing connected to the impulse output of said impulse section;

a plurality of turbine blades rotating on a shaft within said turbine housing, the impulse output positioned to provide a fluid flow to one of said plurality of turbine blades, said turbine blades being substantially immersed in a hydraulic fluid; and a return passage connecting the hydraulic fluid within said turbine housing to the impulse cylinder, whereby the fluid flow created by said impulse section causes said plurality of turbine blades to move rotating the shaft for doing work.

9. A hydraulic impulse motor as in claim 8 further comprising:

a pump connected to said return passage.

10. A method of turning a shaft comprising the steps of:

providing a low pressure source to a pressure amplifier;

amplifying the low pressure from the low pressure source creating a higher pressure;

using the high pressure to move a pressure piston;

striking a free piston with said pressure piston, whereby energy from the high pressure is converted into kinetic energy in the free piston;

generating an impulse of fluid from the kinetic energy of the free piston; and directing the impulse of fluid at a blade of a turbine causing the turbine to rotate.

* * * * *